US006902103B2

(12) United States Patent
Machery

(10) Patent No.: US 6,902,103 B2
(45) Date of Patent: Jun. 7, 2005

(54) BENDABLE CORRUGATED PAPERBOARD

(75) Inventor: Charles J. Machery, Evanston, IL (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 10/342,919

(22) Filed: Jan. 15, 2003

(65) Prior Publication Data

US 2003/0150904 A1 Aug. 14, 2003

Related U.S. Application Data

(60) Provisional application No. 60/348,786, filed on Jan. 15, 2002.

(51) Int. Cl.[7] ..... B65D 5/00

(52) U.S. Cl. ..... 229/100; 229/930; 229/931

(58) Field of Search ..... 229/100, 930, 229/931; 493/354

(56) References Cited

U.S. PATENT DOCUMENTS 1,288,132 A * 12/1918 Nagle ..... 229/100
1,758,230 A * 5/1930 Lange ..... 428/154
2,173,927 A * 9/1939 Allen ..... 493/338
2,319,641 A * 5/1943 Speir, Jr. ..... 229/199
2,458,867 A 1/1949 Messersmith
3,199,763 A * 8/1965 Anderson ..... 229/126
3,481,813 A * 12/1969 Wiggers ..... 156/211
3,526,566 A * 9/1970 Mcilvain, Jr. et al. ..... 428/121
3,955,677 A * 5/1976 Collingwood ..... 206/453
5,322,215 A * 6/1994 Roccaforte ..... 229/225
5,888,183 A 3/1999 Ruthenberg et al.
2002/0166887 A1 * 11/2002 Matsuoka ..... 229/117

* cited by examiner

*Primary Examiner*—Tri M. Mai
(74) *Attorney, Agent, or Firm*—Thomas W. Barnes, III

(57) ABSTRACT

This invention provides a paperboard with an improved score line, the method for making the improved score line, and the apparatus for imparting the improved score line. The score line makes the process of folding a flat paperboard into a corner an easier and more consistent process. The score is a V-shaped groove fashioned from a bar score line flanked by two parallel slit cut lines. The method for creating the score line includes utilizing different scoring hubs for bar scoring and slit scoring the paperboard. The apparatus for creating the bar score is a four shaft slitter-scorer having multiple shafts in series, wherein each shaft has at least one hub for slit scoring, bar scoring or supporting the paperboard.

10 Claims, 6 Drawing Sheets

FIG.1
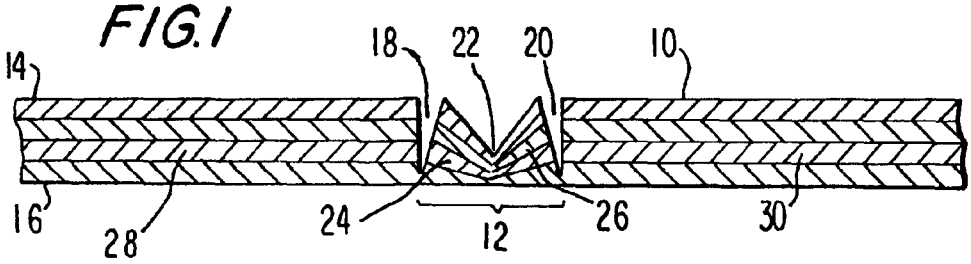
FIG.2
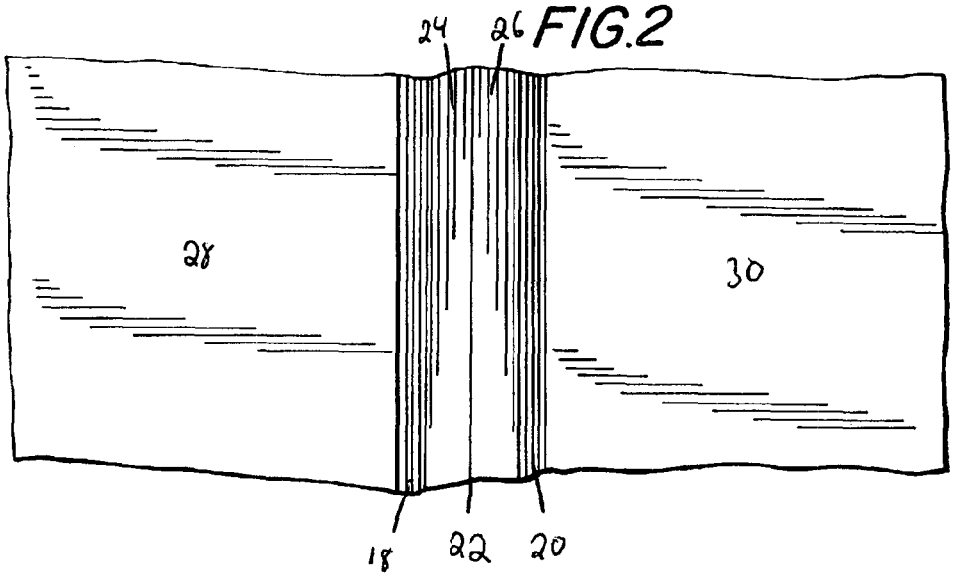
FIG.3
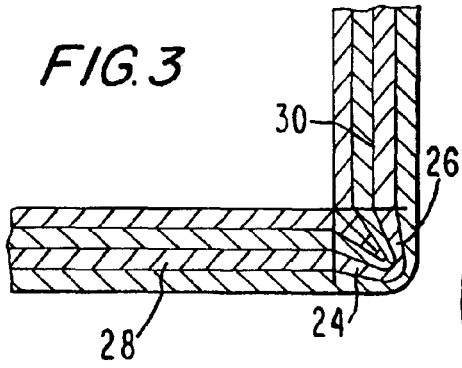
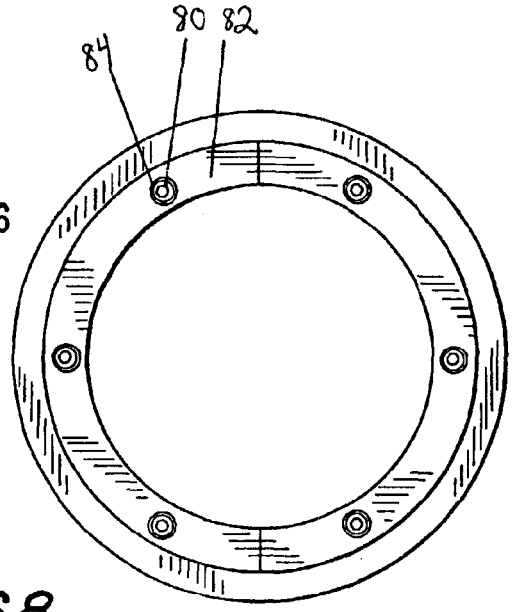
FIG.8

BENDABLE CORRUGATED PAPERBOARD

RELATED APPLICATION

This application claims the benefit of Provisional Application Ser. No. 60/348,786, filed Jan. 15, 2002.

FIELD OF THE INVENTION

The present invention relates to an improved method for scoring and folding corrugated paperboard, an apparatus for implementing the method, and a paperboard formed from the method. In particular, the present invention relates to a scoring method that imparts scores on a paperboard, creating bendable joint score lines that facilitate folding of the paperboard into corrugated containers, trays and the like.

BACKGROUND OF THE INVENTION

Corrugated paperboard is typically used in many different applications, for example, to form boxes, cartons, or dividers for holding, storing or shipping various items. To use the corrugated paperboard for these purposes, it is necessary to be able to bend a corrugated paperboard blank to form corners and walls. Typically, the corrugated paperboard is scored with an indentation or cut line. Paperboards are most often manipulated by automated machines in a continuous in-line process involving cutting, scoring and molding continuous sheets of paperboard into blanks of a desired configuration. The paperboard is then folded along the score or cut line to form a corner. The blanks may be folded into a container by an automated machine, or by a consumer, along the score lines into a box, carton, or other container.

Most score lines are typically created from a single impression or cut line. However, folding along a single line is a problematic, occasionally difficult procedure, allowing for uneven folds, bulging appearance, and consumer frustration. Other score lines have a V-shaped appearance, created by routing (cutting by removing material) a V-shaped channel through a multi-ply paperboard. The V-shaped channel improves the bendability of paperboard by increasing the ease and consistency of folding. However, formation of the channel through routing is a slow, noisy and dusty procedure that generates large amounts of useless paperboard debris.

Therefore, it is an object of this invention to provide a more efficient method for forming a bendable corrugated paperboard with less debris, and a paperboard with improved bendability.

SUMMARY OF THE INVENTION

The present invention comprises a scoring method and a scoring apparatus for use in imparting bendable scores on paper and paperboard products, increasing the speed of scoring and reducing the amount of dust created.

The scoring method comprises the steps of slitting a paperboard with two substantially parallel cut lines and indenting the same paperboard with a bar score to form a tuck score. The paperboard can be first slit scored and then bar scored or bar scored and then slit scored. Further embodiments of the method include scoring the paperboard with a bar and dual slit scores at the same time.

A scoring apparatus of one embodiment of the invention includes multiple cylindrical hubs operably connected to multiple rotatable shafts, which in turn are supported and maintained by a base structure. Each hub either imparts a cut score line, a bar score line, or provides lower support for the paperboard. Paperboard lies on the platform in reachable proximity to the hubs. The hubs function in operable connection to the rotatable shafts, wherein the shafts rotate and turn the hubs in a circular rotation, causing the hubs to grip the paperboard and creating movement of the paperboard away from the platform. A first hub rotates and imparts two substantially parallel slit scores on the paperboard. The paperboard moves to the second hub, which imparts a bar score on the paperboard between the two substantially parallel slit scores.

In one embodiment of the invention, the scoring apparatus includes at least four cylindrical hubs in a series of two sets of two, wherein the first hub set has a slitter scoring hub and a slit score backer hub. The slitter scoring hub has two substantially parallel slit score blades encircling the hub around the circumference of the hub. The second hub series includes a bar scoring hub and a bar scoring hub backer. The bar scoring hub has an elevated bar encircling the hub around its circumferences. The backer hubs provide support for the paperboard and scoring means.

In further embodiments, a container blank includes a tuck score, comprising a V-shaped channel including two substantially parallel slit scores along the length of the channel and a bar score impressed between the two slit scores. The blank can be easily and cleanly folded and manipulated by either a machine or a consumer to form a container for a variety of purposes.

Other objects, embodiments, features and advantages of the present invention will be apparent when the description of a preferred embodiment of the invention is considered in conjunction with the annexed drawings, which should be construed in an illustrative and not limiting sense.

BRIEF DESCRIPTION OF THE FIGURES/DRAWINGS

FIG. 1 is a side view of a paperboard scored with a tuck score.

FIG. 2 is a top view of a paperboard scored with a tuck score.

FIG. 3 is a side view of a paperboard folded along a tuck score.

FIG. 8 is a sectional view of the slitter scoring hub shown in FIG. 7 taken along line 8—8.

DETAILED DESCRIPTION

Figure 4:
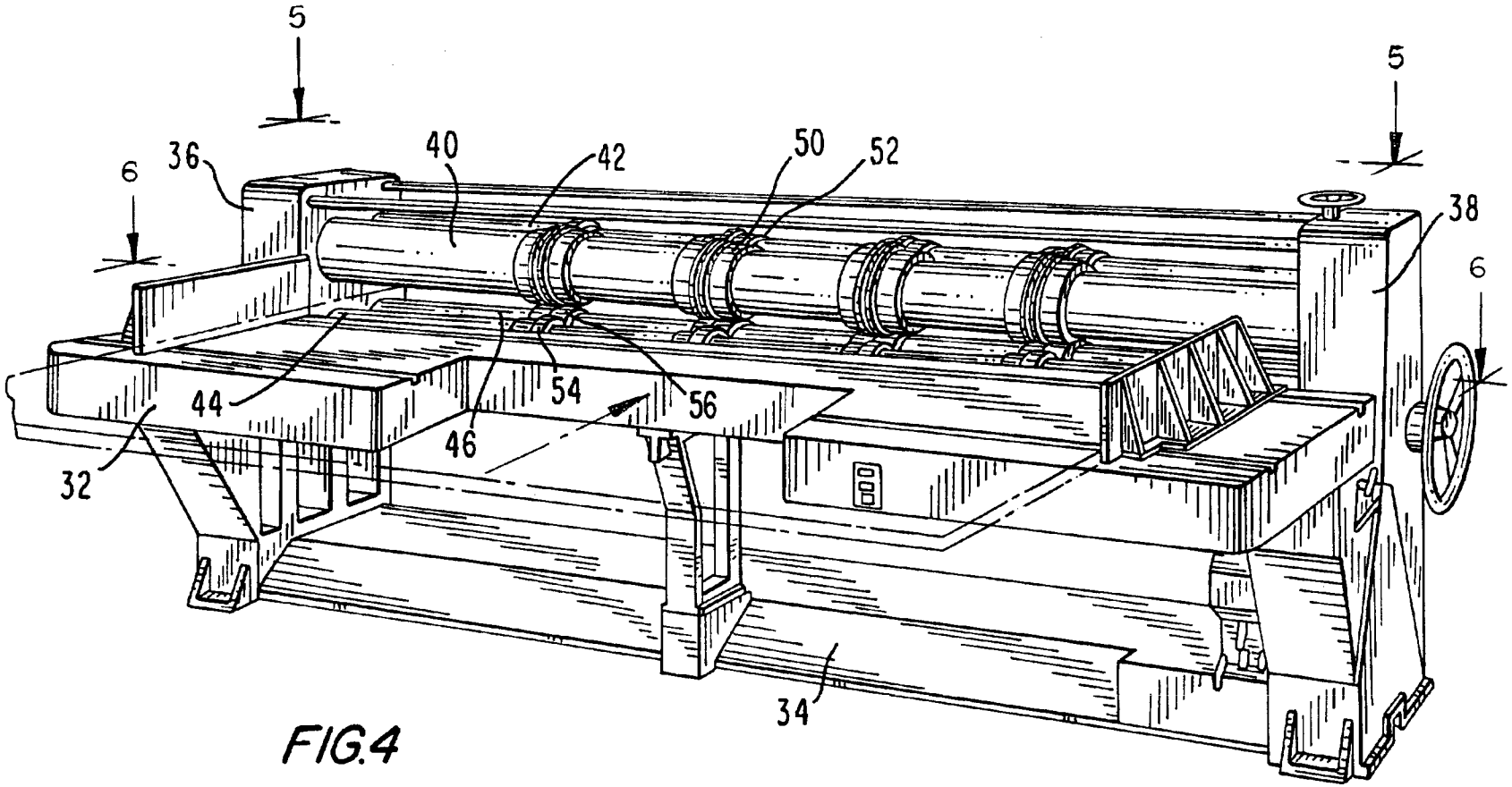
FIG. 4 is a perspective view of an apparatus for forming a tuck score on a paperboard.

A paper or paperboard blank scored in accordance with one embodiment of the invention is shown in FIGS. 1 and 2. A blank 10 is scored for the purpose of folding into a container suitable for holding, shipping or stacking a wide variety of objects. The blank is preferably a flat corrugated paper or paperboard, wherein the paper or paperboard preferably has a thickness of more than one ply (multi-ply). The blank 10 further includes a tuck score 12, two side portions 28 and 30 that flank the tuck score, an interior side 14 and an exterior side 16, wherein both the interior side and exterior side lie in substantially parallel horizontal planes.

Tuck score 12 is a foldable scored area of blank 10 that corresponds to a folded 20 corner on a paperboard container. The resultant corner has a rounded exterior edge and an angular interior edge. When the tuck score is folded, side portions 28 and 30 extend from the tuck score and form side walls of a container. A single paperboard blank may contain as many tuck scores as necessary to fully form a container. For example, if a rectangular paperboard blank 10 included three parallel, spaced apart tuck scores, folding the blank along all three tuck scores could create a four sided open-ended container.

Tuck score 12 is a score that includes two slit score lines 18 and 20, bar score 22 intermediate the two slit score lines, and tuck portions 24 and 26 between each slit score and the bar score. Slit score lines 18 and 20 are on the interior side of the paperboard blank, running substantially in parallel along the length of tuck score 12. Slit scores 18 and 20 extend downward, perpendicular to the horizontal plane of interior side 14. The exact depth of slit scores 18 and 20 can vary as long as it does not extend fully through the paperboard's thickness. Preferably, the portion cut is a majority (more than halt) of, but not the entirety of, the thickness of the paperboard. As a result, exterior side 16 of the paperboard remains smooth. Slit score lines 18 and 20 are preferably equidistantly spaced from one another by approximately ⅝ of an inch across the length of the tuck score. The exact distance between the two cuts lines can vary while maintaining the spirit of the invention, for example, varying the distance in relation to the thickness of the paperboard or the size of the container.

Bar score 22, located between the two slit score lines, is a long, preferably narrow impression on the interior side of the paperboard. The bar score does not cut the paperboard. Instead, it indents the paperboard so that a long, thin impression is formed beneath the horizontal plane of the interior side. Although FIGS. 1 and 2 show the bar score line centrally located between the two slit scores, the precise location can be varied and does not require symmetry. Further, the width of the impression can vary based on the needs of the user. Changing the width of the impression or the distance between the slit scores and the bar score can modify the angle and shape of the corner as desired.

Bar score 22 creates adjacent tuck portions 24 and 26 between bar score 22 and slit scores 18 and 20. Each tuck portion angles downward from the top of the slit scores (where the score first punctures the paperboard) toward the bar score. The two joint portions together form an elongated V-shaped groove with the bar score indentation at the base and the two cut lines at either end. The V-shaped groove and the slit score lines on the paperboard blank form tuck score 12, which corresponds to a folded corner on a folded paperboard container.

To form a corner, tuck portions 24 and 26 and end portions 28 and 30 are rotatable about bar score line 22. Rotating end portions 18 and 20 toward one another in the direction of the paperboard's interior surface causes tuck portions 24 and 26 to tuck under the plane of interior surface 14 of side portions 28 and 30. The rotational force exerted by the end portions causes joint portions 24 and 26 to rotate in kind, thereby forming a corner as shown in FIG. 3. The result is a clean corner easily formed at tuck score 12 having a rounded exterior edge and an angular interior edge.

Figure 5:
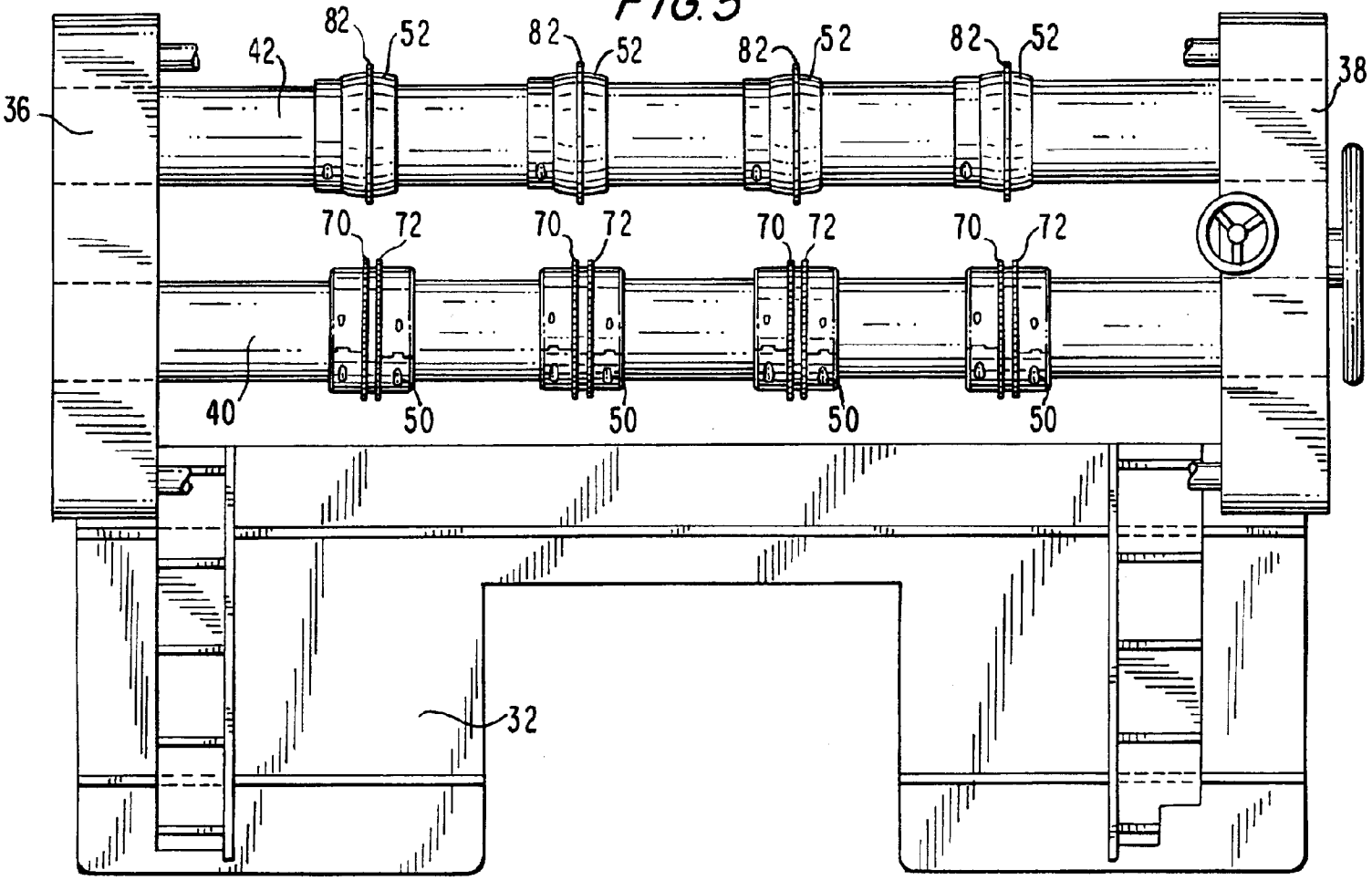
FIG. 5 is a top view of the apparatus shown in FIG. 4, taken along line 5—5.
Figure 6:
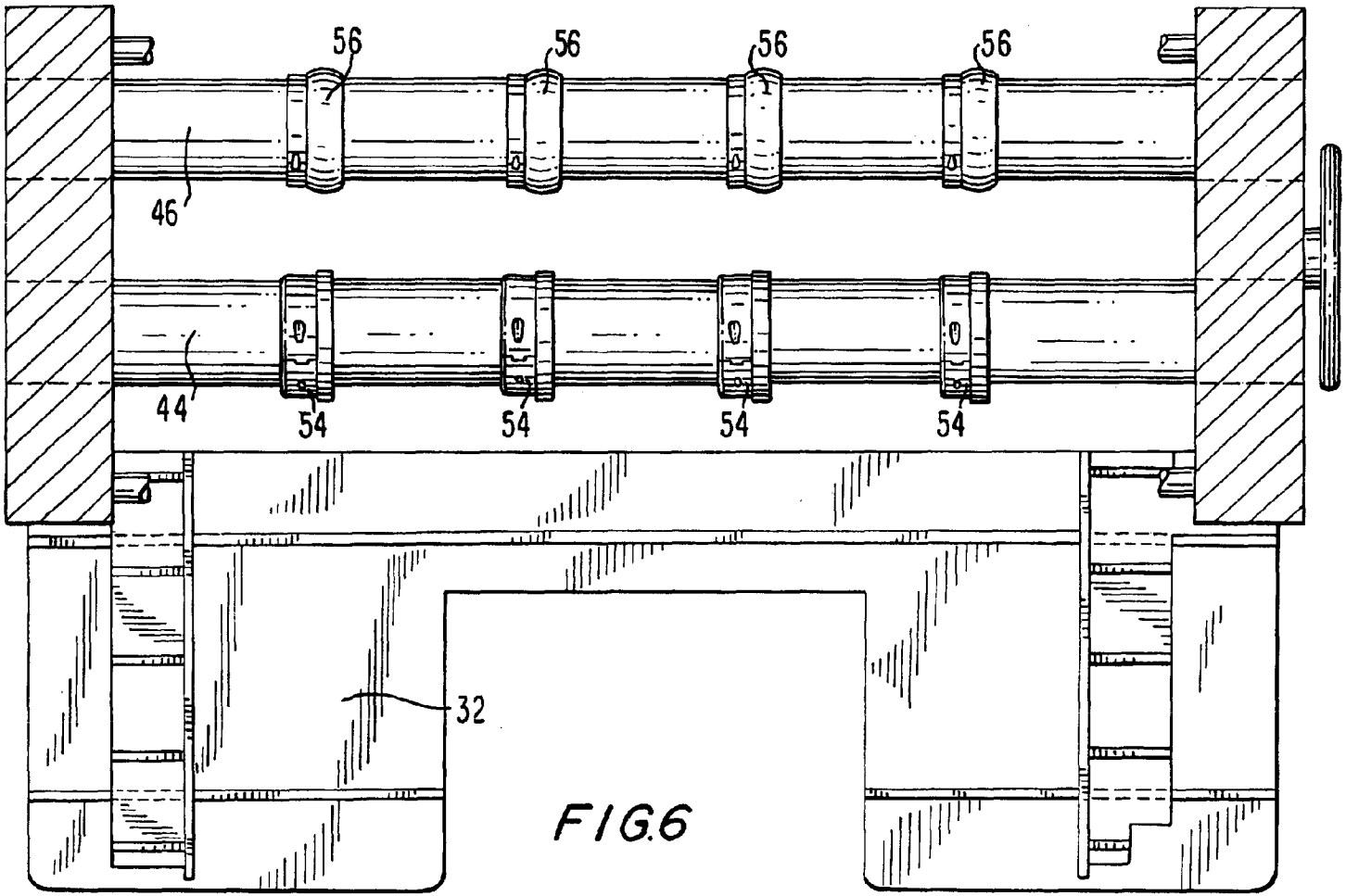
FIG. 6 is a sectional view of the apparatus shown in FIG. 4 taken along line 6—6.

An embodiment of an apparatus for scoring a paperboard with a tuck score is depicted in FIGS. 4, 5 and 6. The apparatus includes a platform 32, a base 34 and at least four shafts. All shafts extend laterally from one end of the base to the other and are attached in a rotatable connection to base arms 36 and 38. Lower shafts 44 and 46 lie generally in the same horizontal plane as platform 32. Upper shafts 40 and 42 lie in a horizontal plane above that of the horizontal plane of the platform, directly above lower shafts 44 and 46, respectively.

Each shaft works in tandem with one other shaft. The shafts that operate in tandem are in a single vertical plane. For example, upper shaft 40 operates in tandem with lower shaft 44, and upper shaft 42 operates in tandem with lower shaft 46. Each shaft rotates in either a clockwise or a counterclockwise motion about a lateral axis that runs through the center of the respective shaft cylinder. Each shaft in tandem rotates in a motion relatively opposite the other shaft in the tandem. In the present embodiment, upper shafts 40 and 44 spin in a counter-clockwise direction relative to base arm 38, and lower shafts 42 and 46 spin in a clockwise direction relative to base arm 38.

Each shaft operably supports one or more hubs, which are hollow, cylindrical devices made of meehamite or other similar metal or cast iron materials. Therefore, when any shaft rotates along its lateral axis, the supported hubs spin at the same speed and in the same direction as the rotating shaft. Further, each hub on a shaft is aligned in the same vertical plane as at least one hub on a corresponding shaft in a vertical plane, and is aligned in the same horizontal plane as at least one hub on a corresponding shaft in a vertical plane. For example, hubs 50 arc vertically aligned with hubs 54 and horizontally aligned with hubs 52.

Every hub either has the ability to impart a score line or to support a piece of paperboard. Slitter scoring hubs 50 have the ability to impart dual cut score lines. Bar scoring hubs 54 have the ability to impart non-piercing bar indentations. Slit score backer hubs 54 support paperboard in a functional relationship to slitter scoring hubs 50. Bar score backer hubs 56 support paperboard in a functional relationship to bar scoring hubs 52.

Each individual shaft may support one or more slitter scoring hubs, bar scoring hubs or backer hubs. In the present embodiment, upper shaft 40 contains four slitter scoring hubs spaced across the bar, and lower shaft 42 has four corresponding bar scoring hubs aligned in series with the slitter scoring hubs. Lower shafts 44 and 46 each contain four backers aligned with the scoring hubs to provide scoring and paperboard support. A slit scoring backing hub is supported by and securely attached to the lower shaft 44. A bar scoring backer hub is supported by and securely attached to lower shaft 46.

Figure 7:
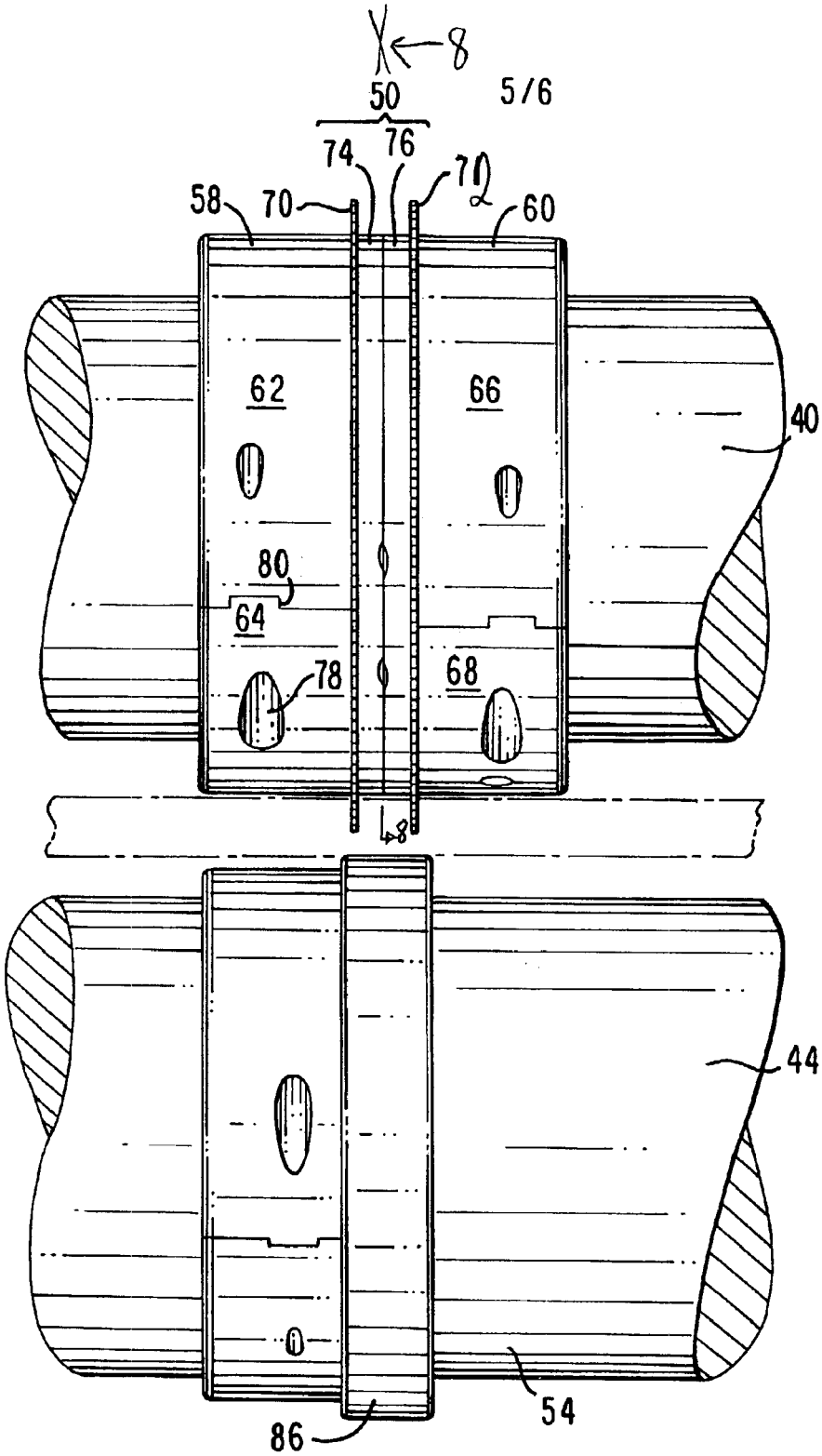
FIG. 7 is an enlarged view of a slitter scoring hub and a slit score hacker hub in vertical alignment for use in the apparatus shown in FIG. 4.

A slitter scoring hub 50 is best seen in FIGS. 7 and 8. The hub, utilized for imparting substantially parallel dual cut lines in a paperboard, comprises cylinders 58 and 60, blades 70 and 72, and spacers 74 and 76. All of these components lie flush together, giving the appearance of a composite piece without physically attaching or bonding to one another.

Each cylinder 58 and 60 is further made up of two smaller segments. For example, cylinder 58 is made up of segments 62 and 64. These segments lie flush together, but do not bond, in an interlocking formation along border 80. The interlocking formation may be any formation known in the art that facilitates a secure non-bonded connection of two separate pieces. Every segment has a specific, arcuate shape specifically molded to fit around a shaft of a predetermined circumference. The segments connect to the shaft with a pressure grip utilizing a bolt and screw system. This connection is facilitated by at least one sunken joint formed though the body of each segment, wherein the sunken joint extends from the top of the circumference of the segment to the shaft. For example, a screw extends through sunken joint 78 formed into the body of segment 64, and presses directly and firmly against shaft 40. The screw holds segment 78 securely in place without physically bonding it to shaft 40.

Each slitter scoring hub further has two arcuate blades 70 and 72. Each blade is made up of two half circles that, when placed end to end, encircle the entire circumference of the shaft. "The exterior edge of the blades has a serrated edge, or any edge of the type typically used in the art to remove a section of a corrugated paperboard at their respective cutting points to form slits.

The interior edge of the blades directly touch shaft 40. Both blades are mounted on the entire circumference of shaft 40 and are wedged securely in place by the combined pressures of the shaft, cylinders 58 and 60 and spacers 74 and 76. Each blade lies flush between these parts without bonding to any of them. Such a non-bonded connection allows the blades to be replaced without fully dismantling or replacing other parts of the hub.

The blades are spaced apart by two spacers 74 and 76. Each spacer is made up of two half-circles, that, when laid end to end, encircle the entire circumference of the shaft. The spacers lie between the adjacent blades without physically bonding to the blades. Further, the spacers attach to shaft 40 in a non-bonded connection facilitated by a grip created by the interior side of the spacer lying securely flush against the shaft. Since the spacers are not bonded to the shaft or the adjacent blades, spacers can be replaced without substantially disbanding the slitter scoring hub.

As seen in FIG. 8, a sectional view of one half of the slitter scoring hub, each spacer further contains at least one screw 80 that extends through at least one sunken joint in the spacer's outer side 82. Sunken joint 84 is specifically designed so the top end of the screw 80 does not extend past the spacer's outer side 82. Instead, the entirety of screw 80 is buried within the spacer. This arrangement allows the spacer's outer side 82 to lie flush against the outer side of an adjacent spacer without obstruction by the top end of the screw.

The main purpose of the spacers is to separate the dual blades at a specifically measured distance. The measured distance between the blades corresponds to the distance between the cut lines of tuck score 12. Therefore, spacers of different widths can be substituted to vary the spacing of the cut lines. One or both segments can be replaced without altering the functionality of the apparatus. In an embodiment shown in FIG. 7, spacers 74 and 76 each have widths of 5/16 of an inch. As a result, the additive widths of the two spacers total 5/8 of an inch. This total width creates a 5/8 inch separation of blades 70 and 72, which in turn results in a tuck score with 5/8 inch separation between the two substantially parallel cut lines.

The apparatus further contains at least one bar scoring hub 52 for imparting a bar score on a paperboard intermediate the two substantially parallel cut lines. Hub 52 is horizontally aligned in series with a slitter scoring hub 50, as shown in FIG. 4. The hub is preferably made of a cast iron material, although it can be made of any material known in the art for imparting bar scores. The hub, further shown in FIG. 9, contains a single annular, ring-shaped bar 82 that is formed into the entire circumference of the scoring hub. Bar 82 is thin and imparts the bar score line intermediate the two slit cut lines. The elevation of the bar can be any desired height to impart a bar score 22 of a corresponding depth. Similarly, the width of the bar can be any desired width to impart a bar score 22 of a corresponding width. The depth or width of the bar score indentation can be easily altered as desired by using a bar scoring hub with a different bar score elevation and/or thickness.

The bar scoring hub is supported by and securely attached to shaft 42 with a bolt and screw system similar to that of the slitter scoring hub, wherein the screw extends through sunken joint 84 of the hub and exerts pressure on the shaft, creating a non-bonded connection. The sunken joints are specifically formed so that the top of the screw does not extend past the outer edge of the joint.

The shaft that supports the bar scoring hub may be any of the shafts of the apparatus. However, the particular shaft must be in a different shaft tandem than the shaft that supports the slitter scoring hub. Further, the shaft must be in the same horizontal plane as the shaft that supports the slitter scoring hub. In the present embodiment, the shaft that supports the bar scoring hub 52 is shall 42, the upper shaft in the second shaft tandem. In alternate embodiments, bar scoring hub 52 is on shaft 40, with slitter scoring hub 50 in horizontal alignment on shaft 42.

Figure 9:
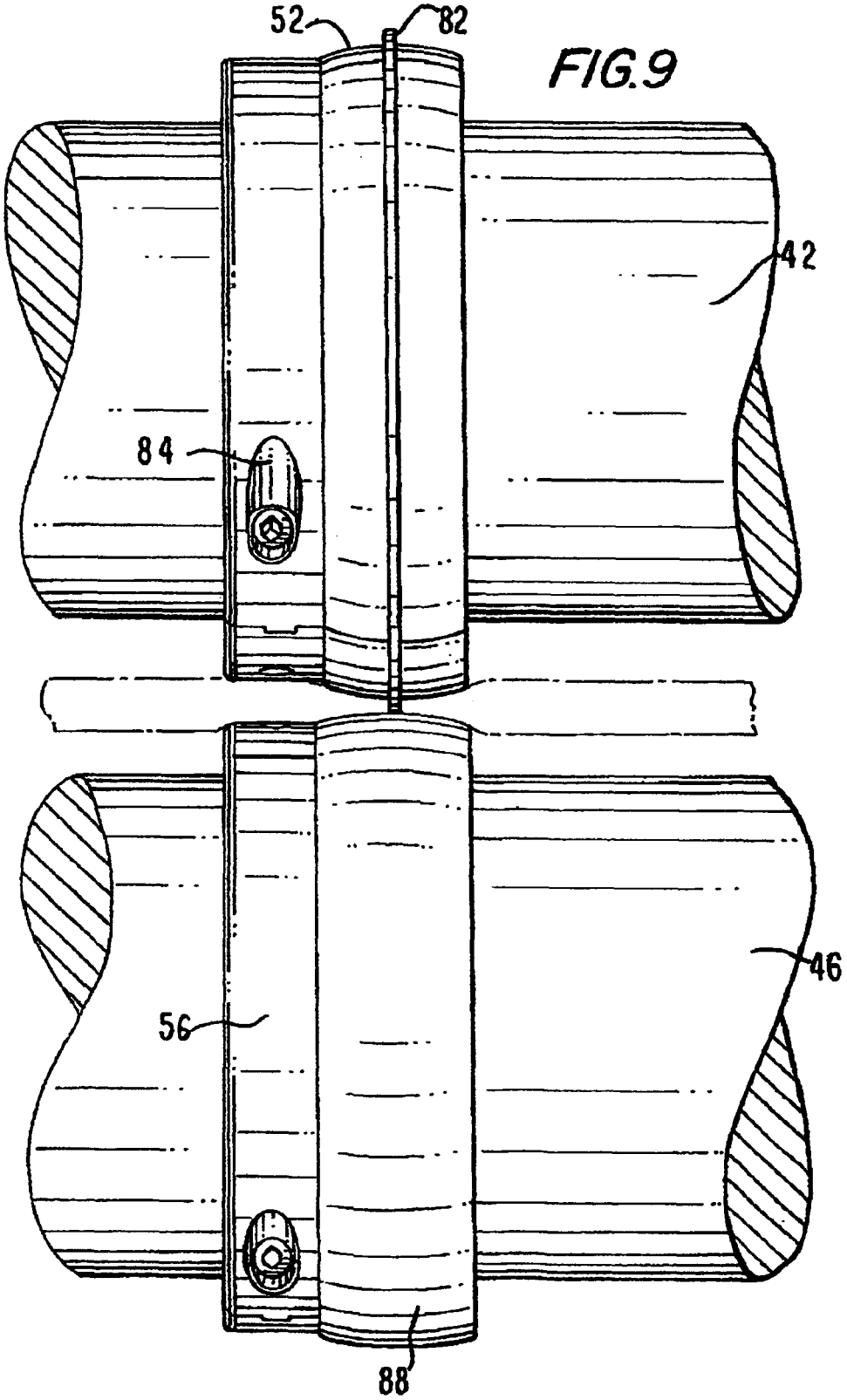
FIG. 9 is an enlarged view of the bar scoring hub and the bar score hacker hub in vertical alignment for use in the apparatus shown in FIG. 4.

The apparatus further comprises two types of backing hubs that work in conjunction with the scoring hubs by providing backing support for the scoring hubs and physical support for the paperboard. Slit backing hub 54 in FIG. 7 provides a backing for slitter scoring hub 50. Bar scoring backing hub 56 in FIG. 9 provides a backing for bar scoring hub 52. Each backing hub has an inner layer preferably made of cast iron and an outer layer preferably made of polyethylene or any other material known in the art for use as a score backing material. For example, slit score hacking hub 54 has outer polyethylene layer 86. The polyethylene material does not necessarily extend across the entire outer surface of the metal inner layer, as shown with outer layer 88 on backing hub 56 in FIG. 9.

The backing hubs are supported by shafts and securely attach to the shafts with a bolt and screw system, wherein the screw extends through a sunken joint of the backing hub and presses finely against the shaft, creating a non-bonded connection. The sunken joints are specifically formed so that the top of the screw does not extend past the outer edge of the joint.

In one embodiment, the two shaft tandems are in series close enough so that the hubs both cut and indent a single paperboard simultaneously and in close proximity. In alternate embodiments, however, the hubs may be spaced apart so that the slitter scoring hub finishes scoring a paperboard before the bar hub begins to score. For proper functionality, one or more additional non-scoring shaft tandems must be placed between the slit and bar scoring shafts tandems.

In other embodiments, as discussed above, the bar scoring hub and bar score backer hub is on the first tandem of shafts and the slitter scoring hub and slit score backer hub is on the second tandem of shafts. In this method, the paperboard is procedurally bar scored first, and slit scored second.

In an additional embodiment, a combination hub is provided having two cutting blades and a bar intermediate the cutting blades, wherein the combination hub can impart two substantially parallel slit scores and a bar score intermediate the slit scores at the same time. In this embodiment, the apparatus for imparting a paperboard with a tuck score only requires two rotatable shafts. The top shaft includes one or more combination hubs that can slit and bar score a paperboard simultaneously. The bottom shaft includes backer hubs in vertical alignment with the combination hubs to provide support for the paperboard and backing for the scoring hub.

Additional embodiments include alternate numbers of score hubs and backer hubs on each shaft. In these embodiments, the paperboard is simultaneously slit and bar scored at any number of locations in accordance with the needs of the user. Alternatively, the apparatus may have additional tandems of shafts, each with at least one scoring hub or backer hub. In these embodiments, the paperboard is cut and scored at multiple locations non-simultaneously. As a result of these embodiments, numerous score line and tuck score arrangements can be created on the paperboard by simply changing the number of hubs, the number of shafts, and/or the location of the hubs on the shafts.

Further embodiments include a feeder device or other apparatus for feeding a paperboard or a continuous stream of paperboards onto platform 32. A box, conveyer belt or other apparatus may also be added behind the final tandem of shafts to either catch the paperboard after it has been fully scored or manipulate the paperboard into a folded container.

One embodiment of a method for creating a bendable corrugated paperboard with tuck score 12 comprises slitting and bar scoring a paperboard with alternate hubs. Slitting and scoring the paperboard with different hubs creates a smooth V-shaped groove in a quick and cleanly manner. The alternate slitting and scoring of a paperboard may be imparted simultaneously at various locations on the paperboard.

The method of alternatively slitting and bar scoring a paperboard to form a tuck score utilizes any embodiment of the apparatus discussed above. A paperboard to be scored is placed on platform 32. Each shaft spins along a lateral axis in a direction relatively opposite than the corresponding shaft in the tandem. In the present embodiment, shown in FIG. 4, upper shafts 40 and 42 spin in downward directions relative to platform 32 (counter-clockwise relative to base arm 38), and lower shafts 42 and 46 spin in an upward direction relative to platform 32 (clockwise relative to base arm 38). The shafts spin at any desired functional speed. Accordingly, the scoring hubs and backer hubs operably attached to the shafts similarly spin in the same directions as the supporting shafts.

Slitter scoring hub 50 and slitter scoring hub backer 54 spin in concert and grip a piece of paperboard that lies in reachable proximity on platform 32. Slit scoring backer hub provides support of the paperboard while slitter scoring hub 50 scores the paperboard with a spinning motion of dual blades 70 and 72. Rotating hubs 50 and 54 simultaneously score the paperboard with dual slit scores 18 and 20 and transport the paperboard away from platform 32 in a direction tangential to the plane of the platform. The imparting of slit scores 18 and 20 across the length of the paperboard is effected by the movement of the paperboard past the first set of hubs. The second set of hubs, 52 and 56, are operably attached to the second tandem of shafts 42 and 46, and lie in operable proximity to the first set of hubs 50 and 54. As a result, lateral movement of the paperboard continues from the first set of hubs to the second set of hubs. Bar score backer 56 provides support for the paperboard while bar scoring hub 52 imparts bar score between slit scores 18 and 20 with a spinning motion. Rotating hubs 52 and 56 simultaneously score the paperboard with bar line 22 and transport the paperboard further away from the platform in a direction tangential to the plane of the platform. The imparting of bar score 22 across the length of the paperboard is effected by the movement of the paperboard past the second set of hubs.

In alternate embodiments of the method, the paperboard is slit scored and bar scored at the same time. At least one combination huh having the ability to slit and bar score a paperboard is operably attached a top shaft, and at least one backer hub to provide support for a paperboard is operably attached to a bottom shaft in vertical alignment with the combination hubs. The hubs rotate, grip a paperboard on the platform, score the paperboard with two substantially parallel cut lines and a bar score line intermediate the cut lines simultaneously, and transport the paperboard further away from the platform in a direction tangential to the plane of the platform. The movement of the paperboard past the hubs effects the imparting of the cut and bar scores across the length of the paperboard.

While the preferred embodiments of the invention has been illustrated and described, it will be appreciated that various changes can be made therein without departing from the spint and scope of the invention.

What is claimed is:

1. A paperboard blank having a predetermined thickness and having at least one score line formed in one surface thereof to form a corner of a container when the blank is folded about said score line, said score line comprising two spaced apart, substantially parallel cut lines extending more than half way through the thickness of the blank to delineate a section of material between the cut lines, and a V-shaped depression formed in the section of material between and substantially parallel to the cut lines, said V-shaped depression having a depth approximately one-half the thickness of the blank and defining a tuck portion between the depression and each respective adjacent cut line, whereby when the blank is folded about said score line to form a corner, said tuck portions are compressed and folded together at said V-shaped depression with said cut lines lying in substantial contiguous relationship to one another to form an interior corner that is essentially a line, free of material protruding into the interior corner.

2. A paperboard blank as claimed in claim 1, wherein:

said blank comprises multiple plies of paperboard laminated together.

3. A paperboard blank as claimed in claim 1, wherein:

said V-shaped depression has a depth that is a majority of the thickness of the blank.

4. A paperboard blank as claimed in claim 1, wherein:

said cut lines each has a depth that is a majority of the thickness of the blank.

5. A paperboard blank as claimed in claim 1, wherein:

said V-shaped depression is centrally positioned between the two cut lines.

6. A paperboard blank as claimed in claim 2, wherein:

said V-shaped depression has a depth that is a majority of the thickness of the blank.

7. A paperboard blank as claimed in claim 6, wherein:

said cut lines each has a depth that is a majority of the thickness of the blank.

8. A paperboard blank as claimed in claim 7, wherein:

said V-shaped depression is centrally positioned between the two cut lines.

9. A paperboard container having an interior surface and an exterior surface and having at least two sides folded about a score line to form a corner, said at least two sides having a predetermined thickness, and said score line comprising:

two spaced apart, substantially parallel cut lines made in said interior surface, extending through a majority of the thickness, delineating a section of material between the cut lines; and a V-shaped depression formed in the section of material between and substantially parallel to the cut lines, said V-shaped depression defining a tuck portion between the depression and each respective adjacent cut line, said tuck portions being compressed and folded together at said V-shaped depression, with said cut lines lying in substantially contiguous relationship to one another, forming an interior corner that is essentially a line, free of material protruding into the interior corner.

10. A paperboard container as claimed in claim 9, wherein:

said V-shaped depression extends over a majority of the thickness of said at least two sides.

* * * * *